United States Patent [19]

Bastide

[11] 4,226,205

[45] Oct. 7, 1980

[54] AUXILIARY SUBMERSIBLE FOR DEEP-SEA WORK

[76] Inventor: Paul Bastide, 108 rue de Rennes, Paris, France

[21] Appl. No.: 877,846

[22] Filed: Feb. 15, 1978

[30] Foreign Application Priority Data

Feb. 17, 1977 [FR] France ..... 77 04473

[51] Int. Cl.[2] ..... B63G 8/08

[52] U.S. Cl. ..... 114/337; 405/185

[58] Field of Search ..... 114/312–315, 114/321–322, 324, 330, 317, 333, 334, 337, 338, 341, 342; 405/185

[56] References Cited

U.S. PATENT DOCUMENTS

| | | | |
|---|---|---|---|
| 1,274,004 | 7/1918 | Christie | 405/185 |
| 2,519,453 | 8/1950 | Goodman | 114/338 |
| 3,122,121 | 2/1964 | Krauth | 114/337 |

FOREIGN PATENT DOCUMENTS

| | | | |
|---|---|---|---|
| 675516 | 2/1930 | France | 114/312 |
| 261152 | 11/1928 | Italy | 114/312 |

*Primary Examiner*—Trygve M. Blix
*Assistant Examiner*—Jesus D. Sotelo
*Attorney, Agent, or Firm*—Christel, Bean & Linihan

[57] ABSTRACT

This invention relates to naval construction and oceanology. It relates to a one-man submersible characterized, firstly, by external shapes designed to prevent any accidental fouling with any fixed obstacles; secondly, propulsion and steering units which give it excellent maneuverability and the possibilities of quick neutralization of any reaction experienced by the submersible; thirdly, by the fact that the operator has available a system comprising, at the extreme forward part of the submersible a swivelling and extensible tool-holder system with a coaxial and protected swivel seat; finally, a tall horizontal crane with one or two swivelling and extensible jibs, and four hydraulic columns with a special baseplate, these all being features which enable any work to be carried out with increased rapidity, accuracy and safety.

The above submersible has numerous advantageous applications in various areas of ocean exploration and working.

13 Claims, 11 Drawing Figures

Fig: 1
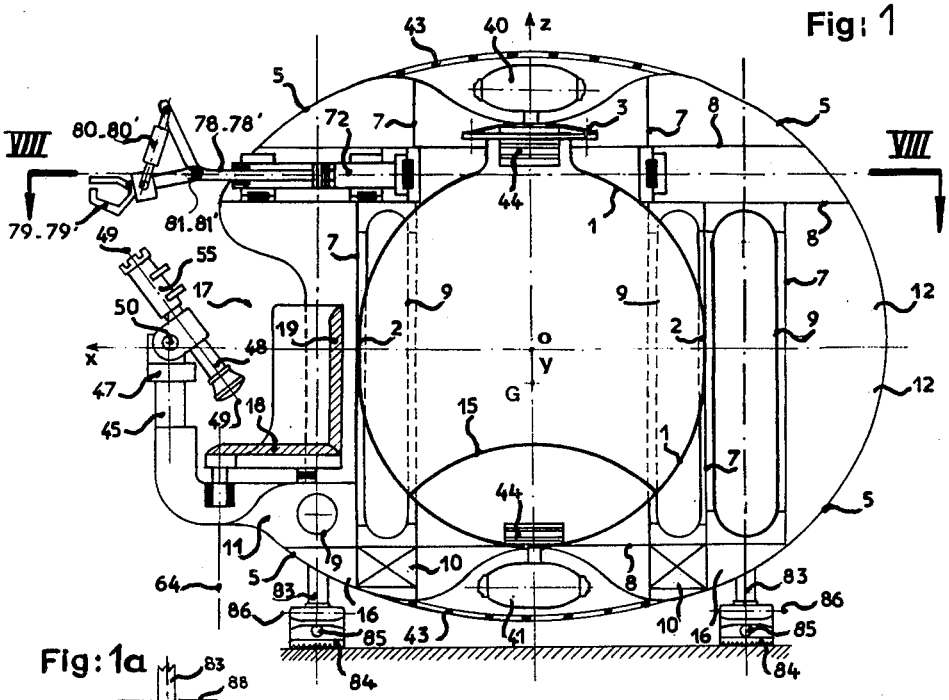
Fig: 1a
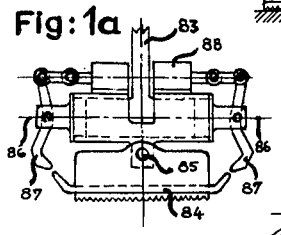
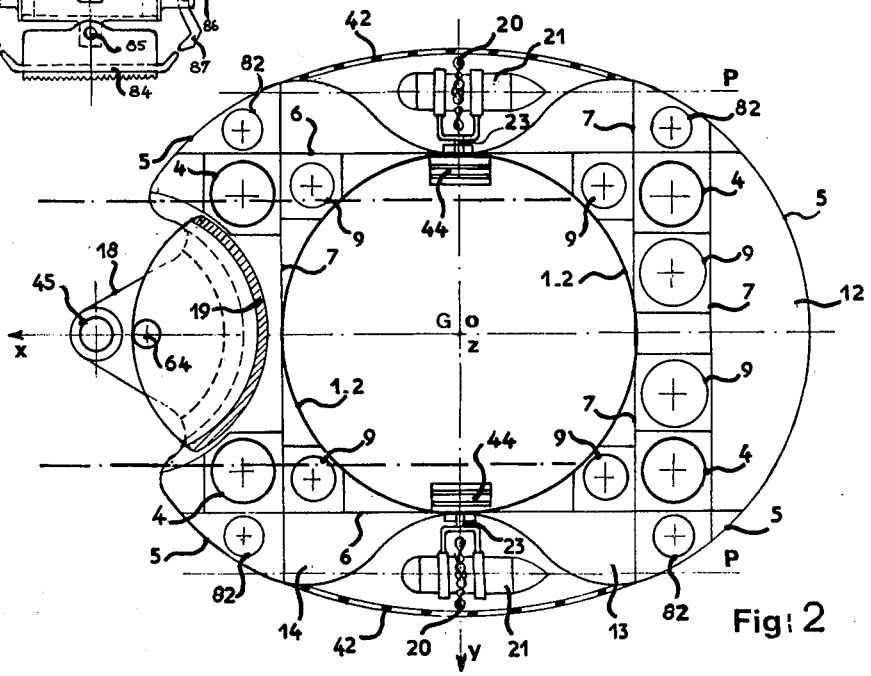
Fig: 2

P
VI
VIa

AUXILIARY SUBMERSIBLE FOR DEEP-SEA WORK

This invention relates to a submersible specially designed as an auxiliary for divers, hereinafter referred to as the operators, where they have to carry out work at great depths on the seabed and, more generally, in a deep-sea medium, e.g. the assembly of or repairs on an offshore natural gas or oil production platform.

The submersible is intended for a number of purposes:

To carry the various pressure gas cylinders required for each operator to breathe, thus reducing the load and substantially freeing him.

To serve as a self-contained floating tool and equipment store which accompanies each operator (or each team) during their movements at the work site.

To provide the operators with a self-contained energy reserve and source (electricity, compressed air, etc) required for their work during each of their movements.

To serve for the fast handling of certain articles forming the subject of the work provided they are light enough not to require the use of more powerful appliances or underwater handling means.

To form a solid extensible and swivelling support for certain of the individual tools used by each operator (or each team) to carry out the work.

To provide directly the force and/or torque required for certain typical simple jobs (traction, thrust, screwing, etc) where the conventional tools used by the operator are inadequate.

To be used as a lift for personnel and equipment in order to serve the various levels of the general subjects of the work.

Finally, to protect each operator against impact from external objects and against sharks.

From the above it will be apparent that the use of one or more submersibles of this type will enable operators to carry out their work with facility, rapidity, accuracy and reliability very much greater than in the case where no such auxiliary is available, while the radius of action and total duration of their movements can be increased.

These submersibles must normally operate over a certain radius around a larger craft which acts as a logistic base and a local energy station for all the personnel and equipment employed on the site, this logistic base of the "underwater habitation" type being either a surface vessel in constant movement or a special submersible anchored or placed on the seabed, depending on circumstances (particularly depending upon the mean depth of execution of the work).

The auxiliary submersible according to this invention is defined by the following text and by the following accompanying drawings, without the descriptive parts having any limiting force.

FIG. 1 is a vertical section of the submersible through its longitudinal plane of symmetry xoz.

FIG. 1*a* is a variant of a vertical leg and base plate.

FIG. 2 is a section of the same appliance through the central horizontal plane xoy.

Figures 3, 4, 5, 6, 6A:
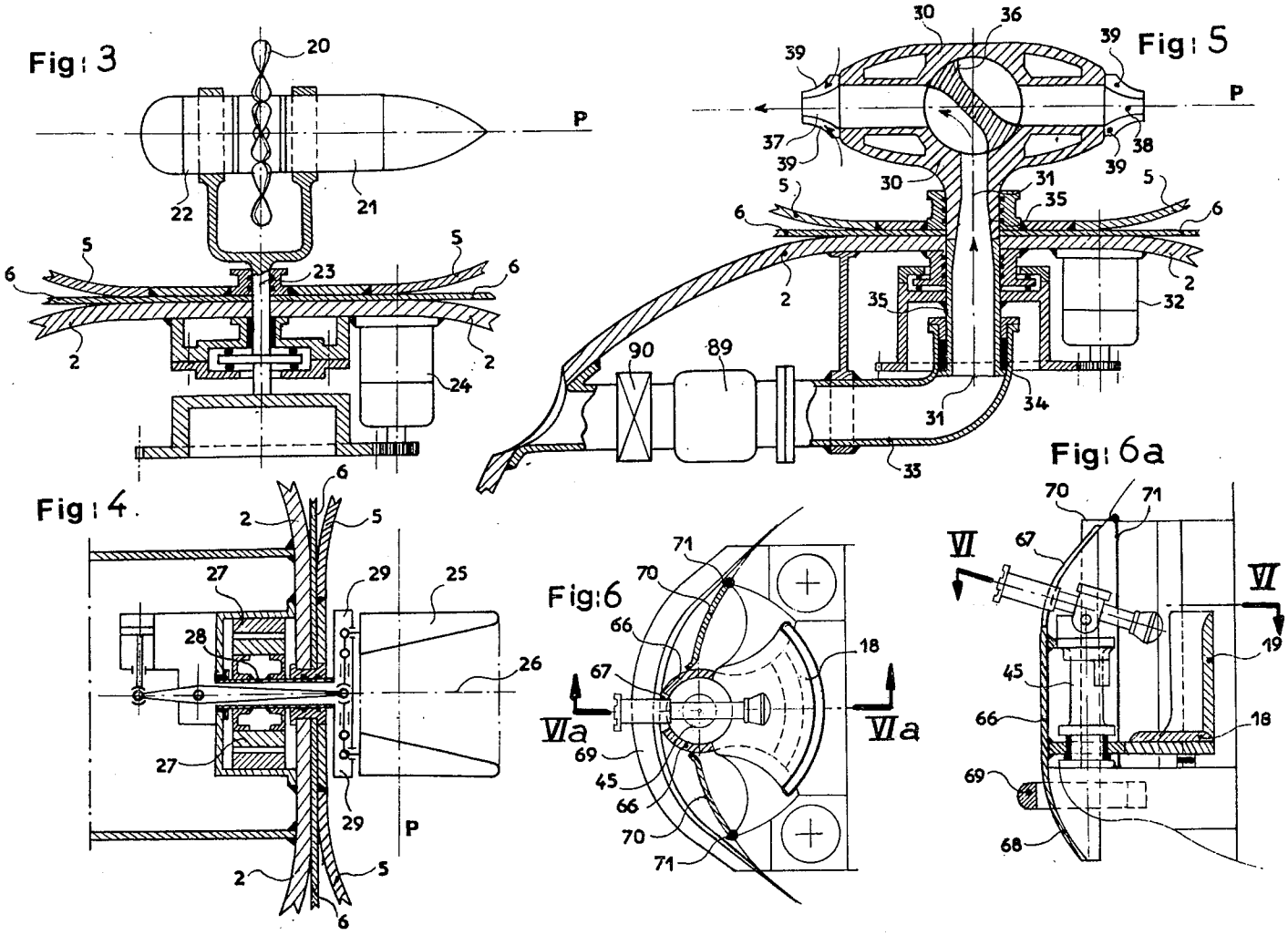
FIG. 3 shows one of the two lateral swivelling propulsions screws (first variant).
FIG. 4 shows one of the swivelling lateral propulsion units in the second variant (cycloidal propulsion units).
FIG. 5 shows one of the lateral swivelling propulsion units in the third variant (jet type units).
FIG. 6 is a top diagrammatic plan view of a variant for the installation of the tool-holder turret and the operator's swivel seat.

FIG. 6*a* is a vertical section along the line VI*a*—VI*a* of FIG. 6.

Figure 7A:
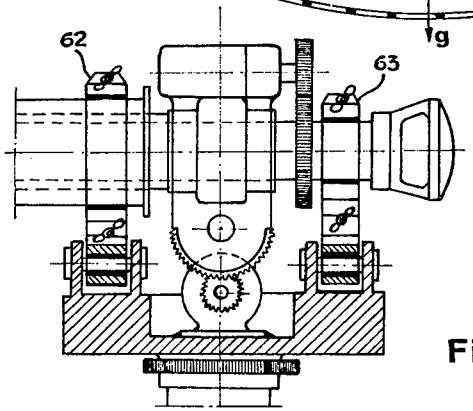
Figure 7:
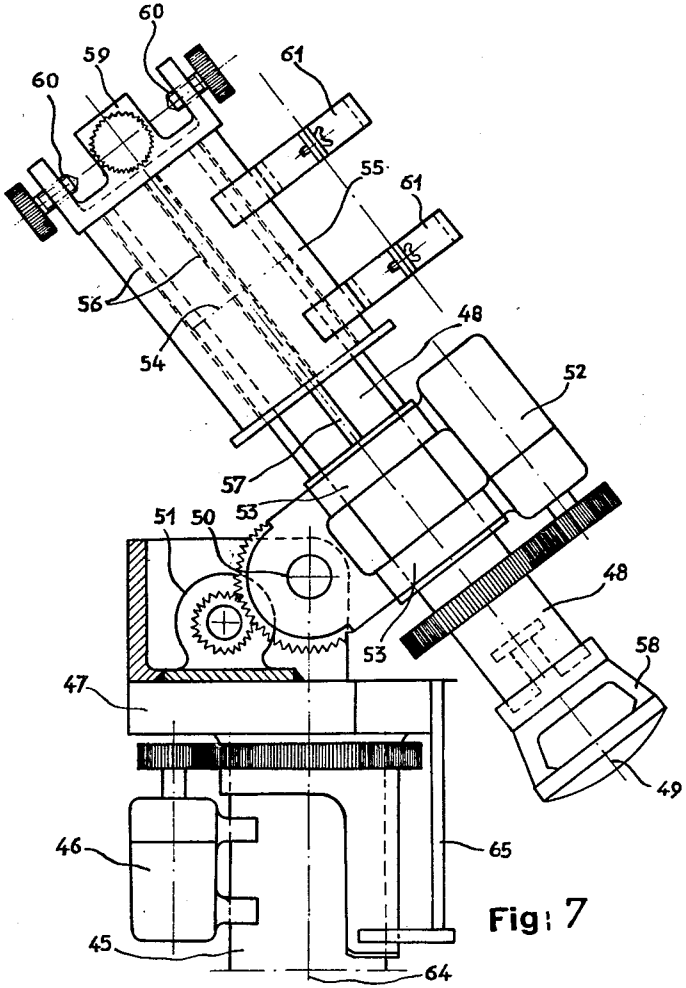

FIG. 7 is a general elevation of one of the possible embodiments of the actual tool-holder turret. FIG. 7*a* is a general elevation of a system for locking the tool-holder jack in the horizontal position.

Figure 8:
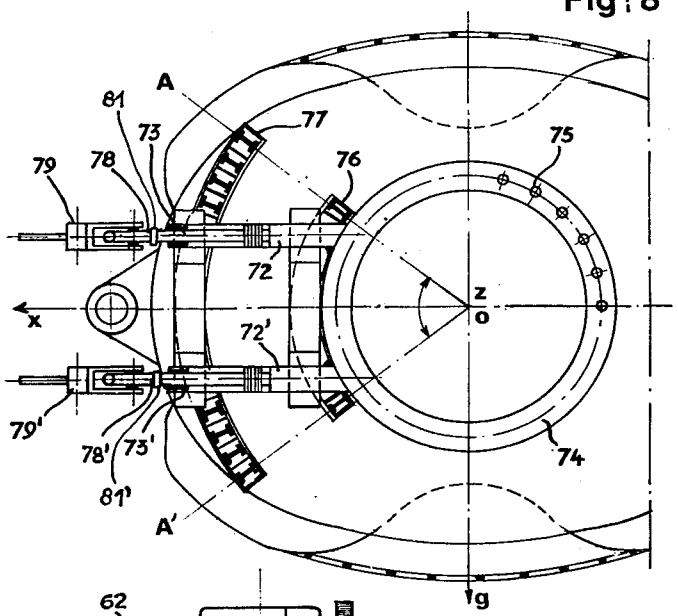

FIG. 8 is a diagrammatical horizontal section of the swivelling system comprising two parallel horizontal telescopic columns situated at the top part of the submersible (FIG. 1 represents a diagrammatic vertical section of this system).

The thick hull of the applicance (FIGS. 1 and 2) is made of a special high-strength steel and consists, firstly, of a sphere or two hemispheres 1 intercommunicating by a cylinder 2 of circular base and of the same radius as (FIGS. 1 and 2), or of a smaller radius than, that of each hemisphere. The top part of the top hemisphere has a sealed inspection hatch 3 (the lightweight parts of the appliance situated above it are removable). Secondly, it comprises four identical vertical cylinders 4 which are symmetrical in pairs with respect to the axis Oz. These four cylinders can be used as list (transverse inclination) or trim (longitudinal inclination) correcting tanks or as appliance compensating tanks. Each of these cylinders is of a material or combination of materials as lightweight as possible, while having compression resistance at least equal to that of the main part of the thick hull 1–2 described above.

The lightweight hull of the appliance consists, firstly of an outer casing 5, whose shape, which is continuous as possible to prevent any accidental fouling of an outer obstacle, is described in FIGS. 1 and 2, and which completely surrounds the thick hull. Secondly it comprises a number of internal plane partitions 6 (parallel to the plane xoz), 7 (parallel to the plane yoz), and 8 (parallel to the plane xoy), which provide a suitable connection between the various parts of the appliance.

The chambers defined by the casing 5 and the various partitions 6, 7 and 8 form non-watertight compartments outside the thick hull, and some of these compartments can be used like the diving water ballasts in ordinary submarines, with "fill" and "drain" valves (not shown in FIGS. 1 and 2 in order to avoid overloading the drawing).

The appliance also comprises a number of other strong cylinders 9 which contain, in suitable proportions and at suitable pressures (greater than the external utilization pressure), each of the gases required for the operator's breathing (oxygen, helium or an oxygen-helium mixture, etc.), or to supply certain tools used by the operator (compressed air, etc), with or without the use of reducing valves. These cylinders are disposed with their axes either vertical or horizontal.

According to the invention, where necessary (and where possible according to specifications in respect of volumes and weights), it is possible to use as an additional compressed-air tank (particularly for blowing the tanks), the chamber defined by the thick partition of spherical shape 15, at the bottom inner part of the bottom hemisphere 1 of the main thick hull.

Also, at the bottom, the appliance comprises a number of accumulator cells 10 disposed in the form of a ring of axis Oz, of the type resistant to, and sealing-tight at, the utilization pressure, these accumulator cells being intended to provide electrical power required to drive the propulsion and maneuvering means described hereinafter, or certain tools, or water pumps serving the above-described correcting and compensating tanks, or jet type propulsion units where used, of the auxiliaries required for operation of the appliance (oil pumps for the various jacks described hereinafter and so on), these pumps and auxiliaries (not shown) being housed either inside the thick hull 1–2 or, when they are of the water-tight type at great depths, in the non-water-tight free spaces between the thick and light-weight hulls, e.g. the free spaces 11, 12, 13 and 14 in FIGS. 1 and 2.

The invention proposes the use of one or more fuel cells as power source.

Weights, which can be released to rise to the surface in the event of difficulties, can be housed in the free spaces 16 at the bottom part of the appliance.

The operator carrying out the work has to pilot the appliance himself and is its sole passenger. He sits inside the recess 17 situated at the front of the appliance, astride the swivel seat 18 with a squab 19. He will wear the standard breathing mask with a reducing valve used for deep divers, the mask being connected to the closest tanks 9 behind his back, which contain the gases or gas mixtures required for his breathing, at the conventional pressures appropriate to the utilization depth. Details concerning the important question of the apparatus available to the operative will be given hereinafter.

The craft is propelled by the following equipment in three possible variants.

The first of these variants (FIGS. 2 and 3) comprises two identical lateral screws 20 whose horizontal axes, in the position of submerged propulsion along the axis ox, are close to the horizontal plane passing through the center of gravity G of the appliance. Each of these screws (FIG. 3) is of the type comprising a built-in electric motor 21 and epicyclic gear 22 (coaxial with the screw), which are water-tight at the pressure equivalent to the utilization depth. Each of these screws can be provided with adjustable and reversible blades. The propulsion unit (motor, reduction gear+screw), is pivotable about the pivot 23 perpendicular to the screw axis by means of another electric motor and reduction gear 24 situated inside the thick hull 1–2, through the agency of a suitable gear train. It will be apparent that the thrust delivered by each of these screws 20 can turn about said pivot 23 while remaining in a vertical plane P parallel to the plane xoz. These lateral screws can therefore propel the appliance in any direction contained in said plane P and, in particular, provide submersion or vertical surfacing of the submersible at full power. Also, if the thrusts of each of these two screws are equal but opposed to one another, the submersible can be pivoted on itself about the axis Ox (thrusts parallel to Oz) or the axis Oz (thrusts parallel to Ox), either at full power or at low power to improve the accuracy of positioning thereof.

The second variant (FIG. 4) comprises two identical cycloidal propulsion units 25 disposed laterally and symmetrical with respect to the plane xoz, the axis of rotation 26 occupying the same position as the pivot axis 23 referred to above in respect of the first variant. Each of these propulsion units is driven by means of a coaxial epicyclic reduction gear by means of an electric motor 27 situated inside the thick hull 1–2, the drive shaft 28 being hollow in a known arrangement and the blade drive crown 29 may be of the type which is water-tight at great depths, which is also already known. It is well known that these sycloidal propulsion units give the same advantages of a high degree of maneuverability (the possibility of various positions of the maximum thrust in a vertical plane P parallel to the plane xoz) as the propulsion unit described in the first variant above.

The third variant (FIG. 5) comprises two propulsion heads 30 of the jet type. Each of these is adjustable about an axis 31 (which occupies the same position as the pivot axis 23 in the first variant) by the action of the electric motor and reduction gear 32 inside the thick hull 1–2. A pump 89 and the valve 90 draws in seawater and delivers it to an intermediate air-cushion tank (not shown), where the pressure is substantially greater than the external pressure corresponding to the utilization depth, and the water reaches the propulsion head 30 via the stationary pipe 33 inside the thick hull 1 - 2 in which a strong straight pipe 35 fixed beneath the propulsion head 30 pivots by means of the water-tight rotating gasket 34. The automatically actuated three-way cock 36 distributes the jet under pressure either to the nozzle 37 or to the opposite nozzle 38, each operating with a siphon effect, the external water being entrained via the gills 39.

Any of the variants used for the systems making up the propulsion equipment can also be used to improve the maneuverability of the submersible and give greater accuracy of positioning of the tool-holder turret described hereinafter. Two other devices 40–41 adjustable about the axis Oz can be added to the devices shown in FIG. 1 to perfect these possibilities, the type of the additional devices being similar to that of any of the three variants described above and they particularly enable the submersible to be moved parallel to the axis Oy on the one hand (if their thrusts are directed in the same direction Oy), or the appliance to be pivoted about the same axis Oy (if their equal but opposite thrusts are directed along the axis ox). The devices 40 and 41 shown in FIG. 1 are, for example, of the jet type according to the third variant of the propulsion unit. However, they may be less powerful than the latter because except in unusual cases they are to be used normally, not for simply propulsion of the submersible (although they can assist this), but particularly for certain maneuvers, e.g. to improve certain positions.

For greater reliability of the movements and maneuvers of the submersible (elimination of the risk of impact with certain large installations situated outside the sumbersible), the two main lateral propulsion units 20–21 and the two additional manoeuvring devices 40 and 41 can be protected (a certain loss of efficiency being accepted) by means of a system of gratings 42–43 to ensure continuity of the shape of the outer casing 5 of the submersible, the actual propulsion and maneuvering units being housed completely (FIGS. 1 and 2) or partially inside cavities formed in said casing.

Again according to the invention the electric motor and reduction gear units described above and by FIGS. 3 and 5 for the orientation of the main propulsion units may each be replaced by a rotary jack or a slow-speed hydraulic motor 44 (FIGS. 1 and 2).

The extreme front part of the submersible has a vertical column 45 immediately in front of the operator (FIGS. 1 and 7) to support an electric motor and reduction gear 46 (or slow speed hydraulic motor), which rotates the turntable 47 about the axis of the column. The turntable supports a hydraulic jack (or a screw jack) 48, of axis 49, and pivotable about axis 50 perpendicular to the axis of the column 45 (and preferably converging therewith) by means of the motor and reduction gear 51 and a suitable transmission. The jack can in turn pivot about its axis 49 by means of the motor and reduction gear 52 fixed on the two collars 53 coaxial with the jack. The free end 54 of the movable male part of the jack bears a cylindrical skirt 55 coaxial with the jack and having, along four internal generatrices diametrically opposite one another in pairs, four grooves 56 adapted to the four guides 57 normally fixed on the outer body of the jack 48 so that the skirt 55 can on the one hand move parallel to the axis 49 of the jack being guided by said guides, while on the other hand it can pivot about this axis with the jack assembly, the bottom of which is held by the operator by the pivoting handle 58. The actual tool, by means of which the operator can carry out the required operation, can be locked either on the head 59 of the movable skirt 55 by means of the point screws 60, or parallel to the top generatrix of this skirt by means of the double opening collar 61. It will be apparent that with the overall system described above the tool itself can be "positioned" both in respect of length and orientation, and then held firmly on a solid seat to carry out the required work. The work can be carried out accurately at any time, because the operator has available the required means to advance the tool parallel to the axis 49 or to pivot it on itself about said axis, or to turn it about said axis parallel thereto, and at a given distance therefrom, as the work progresses.

When the work to be carried out requires a torque beyond the capacity of the electric motor and reduction gear 52, the invention provides that the jack 48 and the sliding skirt 55 can be locked solidly in a position parallel to Ox by means of two opening collars 62 and 63 (FIG. 7*a*), the tool always being locked with respect to the jack as indicated above, and even more strongly if necessary. The high torque perpendicular to the axis ox required to carry out the work (e.g. a screwing or unscrewing operation), can then be provided either by the main propulsion units 20–21 orientated with their axes parallel to Oz and their thrusts equal and in opposition to one another (FIG. 2) or by the auxiliary propulsion units 40–41 oriented with their axes parallel to Oy and their thrusts equal and in opposition (FIG. 1).

As already indicated above, the operator (FIGS. 1 and 2) is situated immediately behind the fixed column 45 astride the seat 18 which is adapted to swivel about the axis 64 situated as close as possible to the column 45 and parallel to the axis thereof. In front of his chest (FIG. 7) is a control panel 65 for all the equipment capable of being used on board the submersible, such equipment being subject to electrical remote control, the corresponding electrical circuits passing through the inside of the column 45, which is hollow, with rotary gaskets at the turntable 47. The panel is attached to the turntable 47 and thus follows all the movements of the jack 48 about the axis of the column 45.

When the work to be carried out requires the axis of the jack to be oriented by a certain angle on either side of the plane xoz, the operator can remain in a convenient position with respect to the jack 48 and the control panel 65 by turning his swivel seat 18 through the same angle. This possibility is facilitated and made more accurate by making the orientation axis of the seat 18 coincide with that of the column 45 (FIGS. 6 and 6*a*). In this case the operator can be further protected against impacts with an external object, and also from sharks, by surrounding the column assembly with a solid protective system 66 at the front and each side, of a transparent plastic material of cylindrical shape at the base and having the same axis as the column 45, the protective system being connected to the seat 18 and therefore rotating with the latter. This system is only open at the top by a vertical window 67 of a width and height just sufficient to allow the axis of the jack to move in a vertical sector by means of the motor 51. This protective system continues downwards (part 68 in FIG. 6*a*) by a height sufficient to protect the operator's legs. A strong fixed fender 69 connected at its sides to the body of the submersible is provided to protect the rotating system 66–68 from the impacts from the front and sides. The operator's protection is completed on each side by two transparent plastic hatches 70 pivotable about vertical hinge pins 71, whereby the operator can reach his seat 18–19, assuming that he is coming from outside the submersible.

In combination with the above seat and the tool-holder jack 48, the invention provides that the operator has available (FIGS. 1 and 8) the revolving crane 72 which is designed so that it can either move an object of appropriate weight in a certain sector AOA' over the immediate forward area of the submersible or vigorously grip an external element to render it stationary in the appropriate position during its treatment by the tool carried by the tool-holder jack 48; or alternatively enable the entire submersible to be attached to an external solid support (e.g., in a large assembly under construction, an element already fitted), in order to neutralize the front of the submersible against any force or torque originating from the treatment of another element. To this end, the revolving crane at the top part of the submersible (but as low as possible to allow combined use with the tool-holder turret, and also for reasons associated with stability of the submersible), consists of one or preferably two horizontal and parallel jibs 73, 73' which are connected to the circular raceway 74 with vertical rollers 75 and can turn about the vertical axis oz of the submersible, being supported on the two horizontal roller runways 76 and 77. These two jibs, which are symmetrical to one another with respect to the plane xoz each comprise a strong jack (hydraulic or screw jack), the movable male rod 78 (and 78') of which bears a strong grab 79 (and 79') at its free end, the grab being movable in a given vertical sector under the effect of the positioning jack 80 (and 80') and rotating about the axes 81 (and 81').

Finally (referring to FIGS. 1 and 2), the submersible is provided with four vertical legs which are symmetrical in pairs with respect to the planes xoz and yoz and are as far away as possible from each of these two planes. These legs each consist of a jack (hydraulic or screw jack), the fixed female part 82 of which can be used vertically to reinforce the general framework of the submersible and the movable male part 83 of which bears at its bottom free end a baseplate 84 connected to the corresponding leg by an orthogonal-axis cardan joint system 85 and 86, giving the baseplate various orientation possibilities which, together with the possibility given by the four vertical jacks of providing different respective horizontal levels for the four baseplates, enables the entire submersible to rest on stationary surfaces even if they are of relatively complex shapes.

Again according to the invention, the baseplate 84 may also be designed with two lateral hooks 87 with an automatic (hydraulic or electric) control 88 (FIG. 1*a*) or with a magnetic engagement system of known type so that the operator can either lift and transport certain metallic components or lock the submersible at its bottom part to neutralize any force or reaction on the submersible of any nature and of any origin, particularly when originating from any work carried out by the operator either directly or by means of the turret and tool-holder jack described above.

The operator also has available the following important and quick-acting means to neutralize any force or torque acting on the submersible. For example, against any horizontal force he can use the horizontal and opposed thrusts delivered either by the two main lateral propulsion units 20–21 or by the two additional top and bottom propulsion units 40 and 41; against any vertical force he can use the vertical and opposite thrusts delivered by the two main lateral propulsion units 20–21; against any torque of axis ox he can use the opposite torque delivered either by the propulsion units 20–21 or by the propulsion units 40–41; against any torque of axis oy he can use the opposite torque delivered by the propulsion units 40 and 41; against any torque of axis Oz he can use the opposite torque delivered by the two propulsion units 20–21.

The invention also covers two simple and rectilinear units of the jet type disposed horizontally and in opposition in the longitudinal plane of symmetry of the submersible at the level of the center of gravity thereof, one forward and the other astern and capable of neutralizing any force in the direction ox acting on the submersible in either direction. These two systems (not shown, in order to avoid overloading FIGS. 1 and 2) are of the same type as each of the two nozzles 37, 38 with the aspirator effect 39 in FIG. 5, and are supplied with water in the same way as they are.

The invention also covers two other pairs of rectilinear units of the same jet type as the above, the first pair being disposed laterally on either side of the axis Ox and directed in two opposite directions parallel to the axis oy, and the second pair being situated at the top and bottom of the submersible in two opposite directions parallel to the axis Oz.

Each of the above six units can act either alone or in combination with the main propulsion units 20–21 or the additional propulsion units 40 and 41 as indicated above.

The invention also covers any submersible of any shape and size having propulsion and steering equipment of any number, nature and power and any general disposition, and having at their extreme front part or on any forward part of their main body one or more of the features, arrangements and equipment according (or equivalent) to those forming the subject matter of the above description and the accompanying corresponding drawings, particularly insofar as concerns the protected or unprotected recess intended for the operator, with its rotating seat, its column, its tool-holder jack adapted to swivel after the style of a universal joint on the above column and also being pivotable about its own axis, and the crane having one or two horizontal jibs with a hydraulically positioned hook and situated immediately above the operator's head.

I claim:

1. A submersible comprising: a thick hull which consists, firstly of a main body formed from two hemispherical elements interconnected by a circular base cylinder having a longitudinal axis, and secondly a system of four identical strong cylinders disposed so as to be capable of being used as trim or list correction tanks and as submersible compensation tanks; a lightweight body, which particularly contains diving ballasts, completely surrounding the main body of the thick hull and having an external shape which is rounded throughout and completely smooth, the only discontinuity in the outline being, firstly in the extreme forward part of the submersible and, secondly, on the longitudinal side walls, and finally on the top and bottom walls, in the form of a plurality of recesses which are open to the exterior as widely as possible and are connected at their periphery to the outer part of the lightweight body of the submersible by connections of very rounded shape; said submersible including two main propulsion and steering devices and two additional propulsion and steering devices; and said lightweight body having an outer surface which comprises firstly, in its two longitudinal side walls, two wide rounded chambers of revolution, the horizontal axis of which passes through the center of gravity of the submersible and which are symmetrical to one another with respect to the vertical longitudinal plane of symmetry of the submersible, and are intended to protect the main two propulsion and steering units of the submersible; secondly, at its top and bottom parts respectively, two smaller rounded chambers of revolution, the vertical axis of which passes through the center of gravity and the center of buoyancy of the submersible and are intended to protect the two additional propulsion and steering devices, each of the four propulsion and steering devices being adapted to receive additional protection in the form of a wide-mesh grating, the general shape of which fits into that of the outer surface of the lightweight body.

2. A submersible according to claim 1, characterized in that it comprises, between the thick hull and the lightweight body a number of strong cylinders containing either oxygen and an oxygen-helium mixture or compressed air, or any other gas required for proper operation or working of the submersible at pressures substantially greater than those of the ambient underwater medium, the total volume of these cylinders being capable of increase by providing an additional tank situated at the bottom part of the thick hull and comprising a recess provided between the wall of the thick hull and an inner partition in the form of a spherical dome.

3. A submersible comprising a thick hull which consists, firstly of a main body formed from two hemispherical elements interconnected by a circular-base cylinder having a longitudinal axis, and secondly a system of four identical strong cylinders disposed so as to be capable of being used as trim or list correction tanks and as submersible compensation tanks, a lightweight body, which particularly contains diving ballasts, completely surrounding the main body of the thick hull and having an external shape which is rounded throughout and completely smooth, the only discontinuity in the outline being, firstly in the extreme forward part of the submersible and, secondly, on the longitudinal side walls, and finally on the top and bottom walls, in the form of a plurality of recesses which are open to the exterior as widely as possible and are connected at their periphery to the outer part of the lightweight hull of the submersible by connections of very rounded shape; the submersible further comprising means for accommodating an operator who is also required to maneuver a working tool, said accommodating means comprising a forward recess and a swivel seat upon which the operator sits astride with his legs hanging on either side of a vertical cylindrical hollow column, the axis of which is close to the axis of orientation of the seat, and an operator's breathing mask connected to the conventional oxygen and oxygen-and-helium mixture cylinders situated vertically or horizontally in a fixed location in the space between the main body of the thick hull and the outer body of the lightweight body of the submersible.

4. A submersible according to claim 3, characterized in that a tool holder device and a control panel are connected to a tool holder turret mounted on said submersible in the location of said recess forwardly of the operator and further characterized in that the operator seated in the recess is provided with an additional protection against impact from external objects or against sharks, such protection comprising a vertical rigid cylindrical casing of transparent plastic material which also protects his legs, coaxial with the column of the tool-holder device and pivotable about the common axis together with the tool-holder turret, the control panel and the operator's swivel seat (which is also coaxial), to which it is connected, such protection being completed by two lateral hatches, also of transparent plastic material, pivotable about vertical hinge-pins borne by the lightweight hull on each side of the recess.

5. A submersible according to claims 3 or 4, characterized in that the operator seated in the recess has available, for his work, a swivelling and extensible tool-holder device comprising a platform situated at the top of the cylindrical column in front of him and adapted to swivel about the vertical axis thereof, such platform in turn bearing a cradle which can itself be swivelled by the operator about a horizontal axis situated at a height close to that of the center of gravity of the submersible and forming with the said axis a universal joint, the cradle supporting a jack device, the axis of which is perpendicular to the second of the said axes and pivotable about its own axis, and the male movable part of which is connected to a sliding skirt which has a second cradle thereon in which the actual tool can be locked.

6. A submersible according to claim 5 characterized in that when the work to be carried out requires a force or torque very much greater than those which can be developed by the jack whereby the jack is pivoted on itself, such jack may be locked firmly in a horizontal position by two collars connected to the swivelling platform, the force or torque then being delivered by the main or additional propulsion and steering units of the submersible, the entire jack then being replaceable by a stronger tool locked in the said two collars.

7. A submersible according to claim 3 characterised in that a device in the form of a swivelling crane is provided at the top part of the submersible slightly above the operator's seat, in a sector of sufficient width on either side of the vertical longitudinal plane of symmetry of the submersible, said crane being adapted to swivel about a vertical axis passing through the center of gravity of the submersible and having at least one horizontal jib, said horizontal jib resting on a horizontal runway and always remaining perpendicular to the above column axis, said jib comprising a jack, the movable male part of which bears at its free and a hydraulically actuated grab adapted to swivel in a vertical plane.

8. A submersible comprising a thick hull which consists, firstly of a main body formed from two hemispherical elements interconnected by a circular-base cylinder having a longitudinal axis, and secondly a system of four identical strong cylinders disposed so as to be capable of being used as trim or list correction tanks and as submersible compensation tanks, a lightweight body, which particularly contains driving ballasts, completely surrounding the main body of the thick hull and having an external shape which is rounded throughout and completely smooth, the only discontinuity in the outline being, firstly in the extreme forward part of the submersible and, secondly, on the longitudinal side walls, and finally on the top and bottom walls, in the form of a plurality of recesses which are open to the exterior as widely as possible and are connected at their periphery to the outer part of the lightweight hull of the submersible by connections of very rounded shape; said submersible including two main propulsion and steering devices and two additional propulsion and steering devices, each of said propulsion and steering devices including means for changing the orientation thereof thereby enhancing the maneuverability of said submersible.

9. A submersible according to claim 8, wherein each of said propulsion and steering devices comprises an electric motor, reduction gear and screw assembly of streamlined shape, the horizontal axis of which is parallel to the main direction of ordinary movement of the submersible, and the support of which can, by motive means, pivot about an axis perpendicular to the aforesaid axis.

10. A submersible according to claim 8, wherein each of said propulsion and steering devices comprises an electric motor, reduction gear and coaxial cycloidal propulsion unit, which is adapted to be oriented and the common horizontal axis of which is perpendicular to the main direction of movement of the submersible.

11. A submersible according to claim 8, wherein each of said propulsion and steering devices comprises an orientable propulsion unit of the jet type fed by a water pump drawing in the seawater and delivering it to the propulsion unit via a strong cylinder containing compressed air at a pressure substantially greater than the external pressure corresponding to the utilization depth.

12. A submersible comprising a thick hull which consists, firstly of a main body formed from two hemispherical elements interconnected by a circular-base cylinder having a longitudinal axis, and secondly a system of four identical strong cylinders disposed so as to be capable of being used as trim or list correction tanks and as submersible compensation tanks, a lightweight body, which particularly contains diving ballasts, completely surrounding the main body of the thick hull and having an external shape which is rounded throughout and completely smooth, the only discontinuity in the outline being, firstly in the extreme forward part of the submersible and, secondly, on the longitudinal side walls, and finally on the top and bottom walls, in the form of a plurality of recesses which are open to the exterior as widely as possible and are connected at their periphery to the outer part of the lightweight hull of the submersible by connections of very rounded shape; said submersible being able to rest on the bed or on a stationary surface by resting on four identical vertical columns which are symmetrical in pairs with respect to the two vertical planes of symmetry of the casing of the submersible, each of these columns being formed by a hydraulic or screw jack, the male part of which bears at its free end a wide baseplate with a fluted surface, which is connected by a universal joint system, of which the two axes at right angles to one another are perpendicular to the axis of the jack.

13. A submersible according to claim 12, wherein said baseplate is provided with a lateral hook having an automatic control for locking the submersible at its bottom part to neutralize any force on the submersible.

* * * * *